US011684174B1

(12) United States Patent
Randle

(10) Patent No.: US 11,684,174 B1
(45) Date of Patent: Jun. 27, 2023

(54) BABY CARRIER

(71) Applicant: Tiffanie Randle, Memphis, TN (US)

(72) Inventor: Tiffanie Randle, Memphis, TN (US)

( * ) Notice: Subject to any disclaimer, the term of this patent is extended or adjusted under 35 U.S.C. 154(b) by 106 days.

(21) Appl. No.: 17/367,709

(22) Filed: Jul. 6, 2021

(51) Int. Cl.
*A47D 13/02* (2006.01)
*A47D 9/02* (2006.01)

(52) U.S. Cl.
CPC ..... *A47D 13/025* (2013.01); *A47D 9/02* (2013.01)

(58) Field of Classification Search
CPC .. B60N 2/2842; B60N 2/2845; B60N 2/2821; A47D 9/02; A47D 13/025
USPC ..... 297/217.4
See application file for complete search history.

(56) References Cited

U.S. PATENT DOCUMENTS

| | | | | |
|---|---|---|---|---|
| 5,588,164 | A | 12/1996 | Proulx | |
| 7,669,927 | B1 | 3/2010 | Zaid | |
| 9,663,004 | B2 * | 5/2017 | Perrin | B60N 2/26 |
| 10,479,235 | B1 | 11/2019 | Stroud | |
| 10,675,548 | B1 * | 6/2020 | Colton | A47D 13/10 |
| 10,702,073 | B2 | 7/2020 | Paperno | |
| 2005/0264063 | A1 | 12/2005 | Babcock | |
| 2007/0040425 | A1 | 2/2007 | Miles | |
| 2010/0231014 | A1 | 9/2010 | Gibree | |
| 2012/0036635 | A1 | 2/2012 | Lapointe | |
| 2012/0280540 | A1 * | 11/2012 | Pedraza | B60N 2/2863 297/148 |
| 2015/0020308 | A1 * | 1/2015 | Reichle | B60N 2/2845 5/93.1 |

FOREIGN PATENT DOCUMENTS

| | | |
|---|---|---|
| WO | 2013123332 | 8/2013 |

* cited by examiner

*Primary Examiner* — Milton Nelson, Jr.
(74) *Attorney, Agent, or Firm* — Kyle A. Fletcher, Esq.

(57) ABSTRACT

The baby carrier is a furniture item. The baby carrier is adapted for use with an infant. The baby carrier is a hand carried item. The baby carrier is a reclined seat that forms a small bed. The baby carrier allows the infant to be carried while resting in the baby carrier. The baby carrier comprises an infant carrier, a control circuit, and a personal data device. The personal data device forms a communication link with the control circuit. The control circuit mounts in the infant carrier. The control circuit rocks the infant carrier. The control circuit vibrates the infant carrier. The control circuit announces audible sounds intended to soothe the infant while in the baby carrier.

13 Claims, 5 Drawing Sheets

BABY CARRIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture adapted for children including small beds for infants, more specifically, a small bed with a rocking mechanism. (A47D9/02)

SUMMARY OF INVENTION

The baby carrier is a furniture item. The baby carrier is adapted for use with an infant. The baby carrier is a hand carried item. The baby carrier is a reclined seat that forms a small bed. The baby carrier allows the infant to be carried while resting in the baby carrier. The baby carrier comprises an infant carrier, a control circuit, and a personal data device. The personal data device forms a communication link with the control circuit. The control circuit mounts in the infant carrier. The control circuit rocks the infant carrier. The control circuit vibrates the infant carrier. The control circuit announces audible sounds intended to soothe the infant while in the baby carrier.

These together with additional objects, features and advantages of the baby carrier will be readily apparent to those of ordinary skill in the art upon reading the following detailed description of the presently preferred, but nonetheless illustrative, embodiments when taken in conjunction with the accompanying drawings.

In this respect, before explaining the current embodiments of the baby carrier in detail, it is to be understood that the baby carrier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the baby carrier.

It is therefore important that the claims be regarded as including such equivalent construction insofar as they do not depart from the spirit and scope of the baby carrier. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
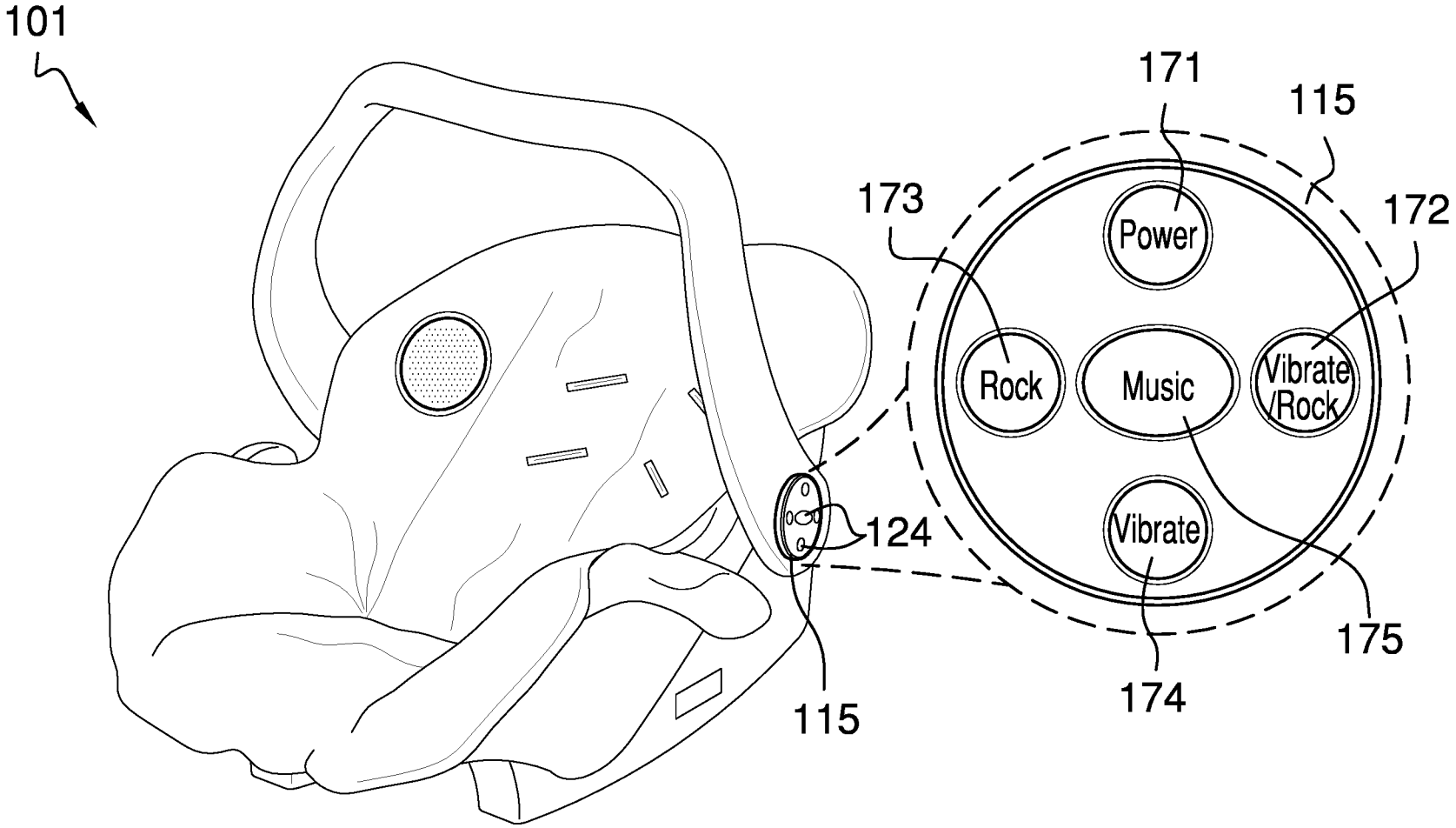
FIG. 1 is a perspective view of an embodiment of the disclosure.
Figure 2:
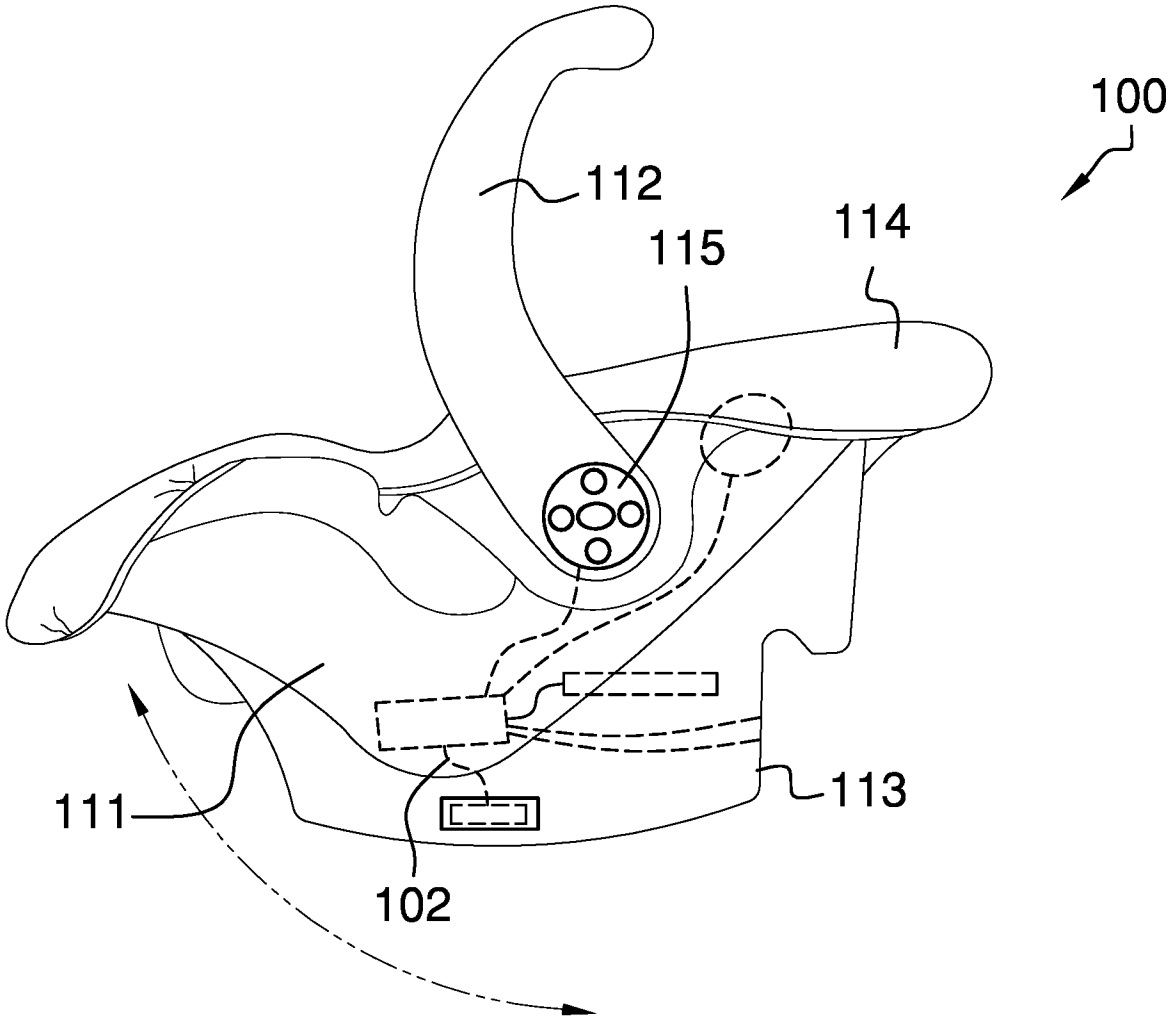
FIG. 2 is a side view of an embodiment of the disclosure.
Figure 3:
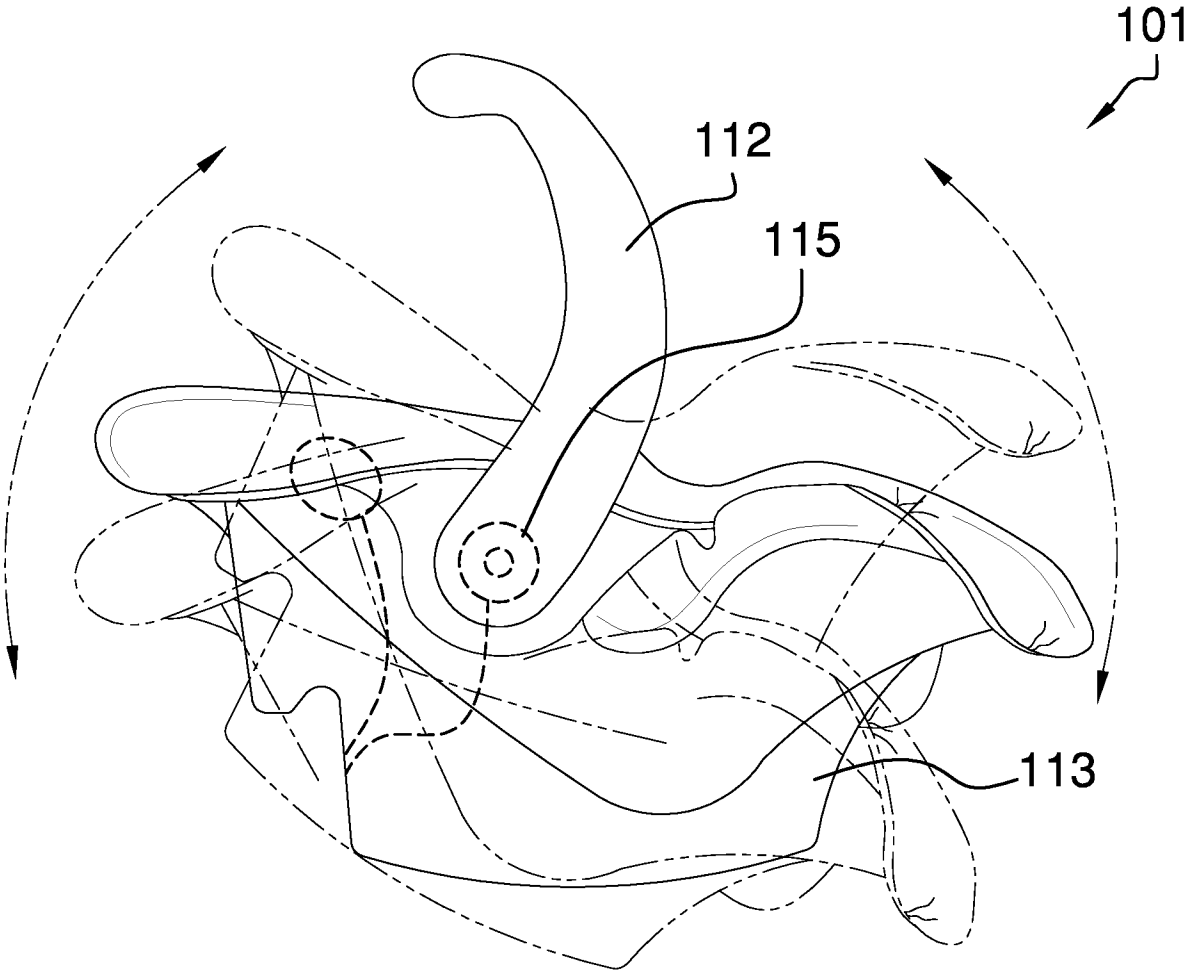
FIG. 3 is a reverse side view of an embodiment of the disclosure.
Figure 4:
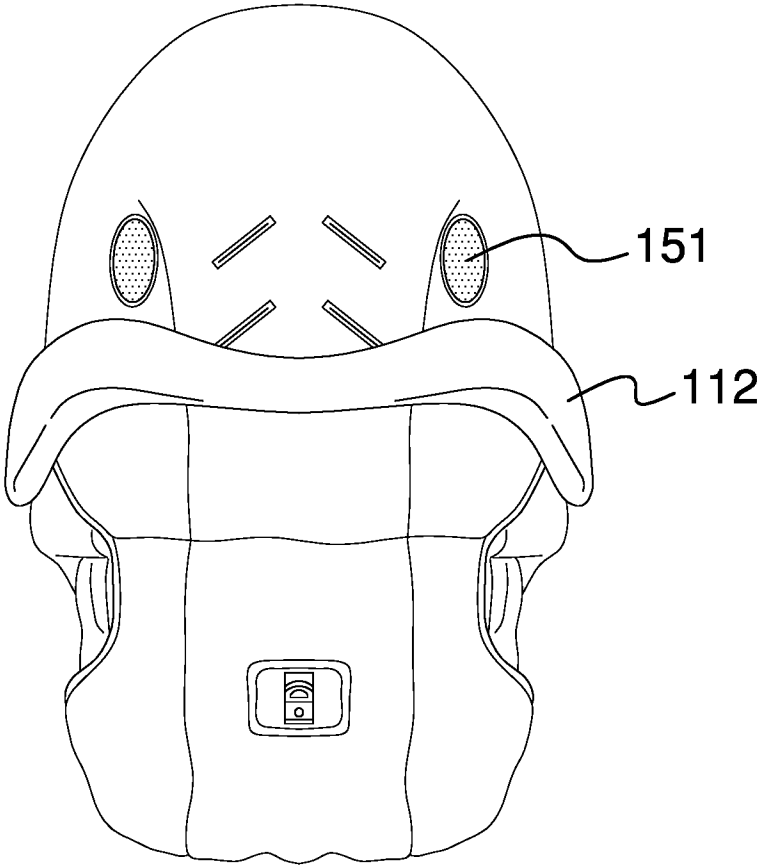
FIG. 4 is a top view of an embodiment of the disclosure.
Figure 5:
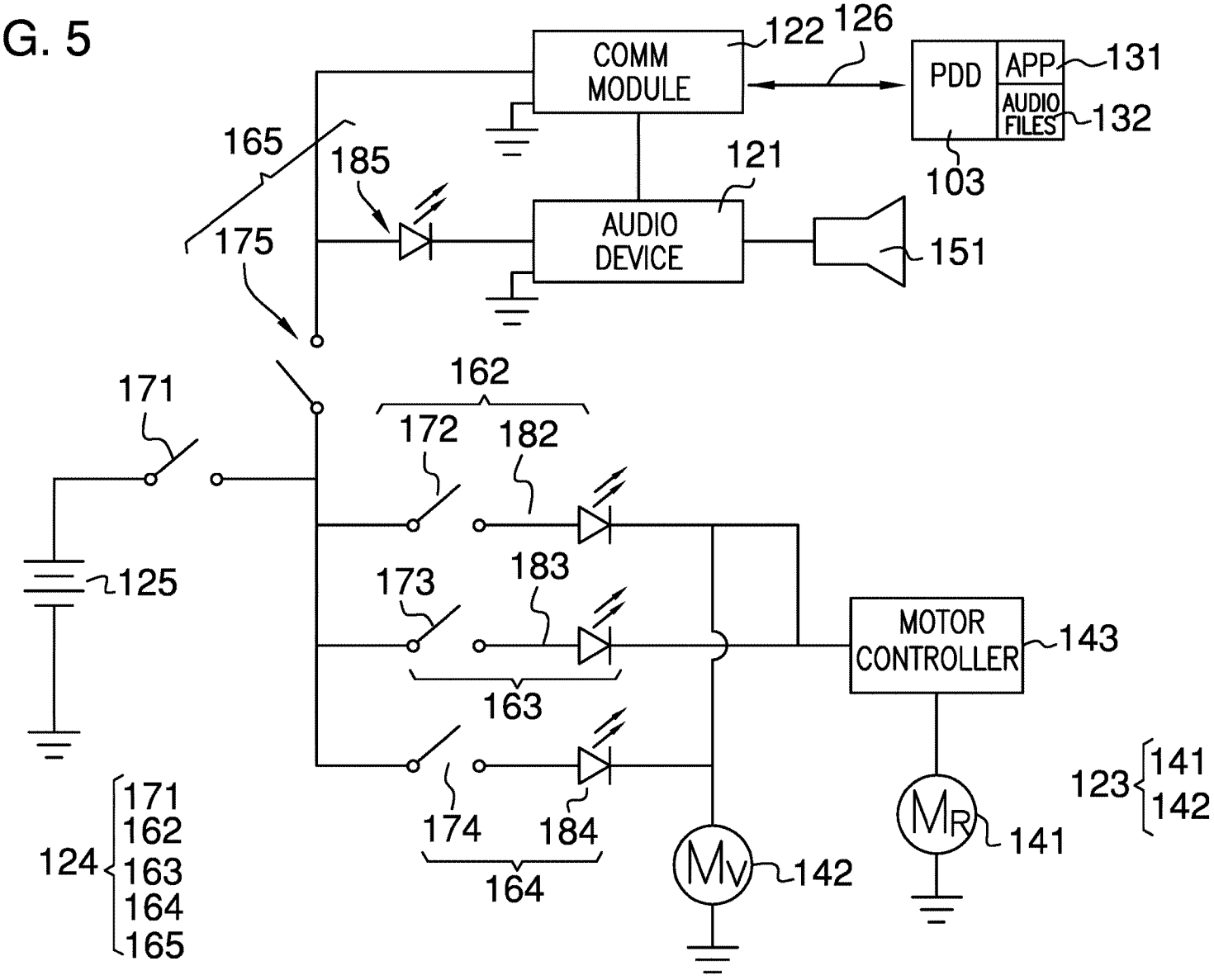
FIG. 5 is a schematic view of an embodiment of the disclosure.

Detailed reference will now be made to one or more potential embodiments of the disclosure, which are illustrated in FIGS. 1 through 5.

The baby carrier 100 (hereinafter invention) is a furniture item. The invention 100 is adapted for use with an infant. The invention 100 is a hand carried item. The invention 100 is a reclined seat that forms a small bed. The invention 100 allows the infant to be carried while resting in the invention 100. The invention 100 comprises an infant carrier 101, a control circuit 102, and a personal data device 103. The personal data device 103 forms a communication link with the control circuit 102. The control circuit 102 mounts in the infant carrier 101. The control circuit 102 rocks the infant carrier 101. The control circuit 102 vibrates the infant carrier 101. The control circuit 102 announces audible sounds intended to soothe the infant while in the invention 100.

The personal data device 103 is a programmable electrical device. The personal data device 103 further comprises an application 131 and one or more audio files 132. The personal data device 103 provides data management and communication services through one or more functions referred to as an application 131. The application 131 is a set of logical operating instructions that are performed by the personal data device 103. The application 131 of the personal data device 103 forms an interface with the control circuit 102. The personal data device 103 transmits the one or more audio files 132 over the wireless communication link 126 to the control circuit 102. The communication module 122 receives the transmitted operating instructions and relays the received operating instructions to the audio device 121.

Each of the one or more audio files 132 is a data structure that is used to store a plurality of sounds that are announced into the infant carrier 101. The audio file is defined elsewhere in this disclosure.

The infant carrier 101 is the furniture item formed by the invention 100. The infant carrier 101 is adapted for use with the infant. The infant carrier 101 forms a small bed used to hand carry the infant while the infant is resting in the infant carrier 101. The control circuit 102 is contained within the infant carrier 101. The infant carrier 101 comprises an IC seat and an IC handle 112.

The IC seat 111 is the structure of the infant carrier 101 that forms the small bed. The infant is placed in the IC seat when the invention 100 is hand carried. The IC seat 111 further comprises an IC shell 113 and an IC cushion 114.

The IC shell 113 is a mechanical structure. The IC shell is a rigid structure. The IC shell 113 forms a supporting structure that forms the reclined seat formed by the IC seat 111. The IC shell 113 further forms a housing that contains the control circuit 102. The IC shell 113 is formed with all apertures and form factors necessary to allow the IC shell 113 to accommodate the use and operation of the control circuit 102. Methods to form an IC shell 113 suitable for the purposes described in this disclosure are well-known and documented in the mechanical arts.

The IC cushion 114 is a pad that lines the reclined seat structure of the IC seat 111. The infant is placed on the IC cushion 114 such that the infant is comfortable and protected from injury while in the infant carrier 101.

The IC handle 112 is a grip that is used to hand carry the infant carrier 101. The IC handle 112 attaches to the IC seat such that the IC handle 112 rotates relative to the IC seat 111. The IC handle 112 further comprises an IC adjustable knob 115.

The IC adjustable knob 115 is a locking structure. The IC adjustable knob 115 locks the IC handle 112 into a fixed position relative to the IC seat 111. The IC adjustable knob releases the IC handle 112 from its fixed position such that the IC handle 112 will rotate relative to the IC seat 111. The IC adjustable knob 115 then relocks the IC handle 112 into its new fixed position relative to the IC seat 111. The IC adjustable knob 115 further provides an interface to the control circuit 102. Specifically, a plurality of switching circuits 124 used to control the operation of the control circuit 102 are accessible from the IC adjustable knob 115 of the IC handle 112.

The control circuit 102 is an electric circuit. The control circuit 102 forms a communication link with the personal data device 103. The control circuit 102 rocks the infant carrier 101. The control circuit 102 vibrates the infant carrier 101. The control circuit 102 receives one or more audio files 132 from the personal data device 103 over the communication link. The control circuit 102 converts the one or more audio files 132 into audible sounds. The control circuit 102 announces the audible sounds to the infant when the infant is in the infant carrier 101. The control circuit 102 comprises an audio device 121, a communication module 122, a plurality of motors 123, a plurality of switching circuits 124, and a power circuit 125. The audio device 121, the communication module 122, the plurality of motors 123, the plurality of switching circuits 124, and the power circuit 125 are electrically interconnected.

The audio device 121 is a programmable electronic device. The communication module 122 is a wireless electronic communication device that allows the audio device 121 to wirelessly communicate with a locally presented device such as a personal data device 103. Specifically, the communication module 122 establishes a wireless communication link 126 between the control circuit 102 and the personal data device 103. In the first potential embodiment of the disclosure the communication module 122 supports a communication protocol selected from the group consisting of a WiFi™ protocol or a Bluetooth™ protocol. In the first potential embodiment of the disclosure, WiFi™ protocol and the Bluetooth™ protocols are enabled such that the wireless communication link 126 can be established using WiFi™ protected setup technology (WPS™).

The audio device 121 further comprises a speaker 151. The audio device 121 receives one or more audio files 132 from the personal data device 103 over the communication link. The audio device 121 converts the one or more audio files 132 into audible sounds. Specifically, the audio device 121 converts the one or more audio files 132 into electrical signals that are transmitted to the speaker 151. The audio device 121 announces the audible sounds into the infant carrier 101 through the speaker 151. The speaker 151 is a transducer. The speaker 151 receives an electric signal from the audio device 121. The speaker 151 converts the received electric signal into an audible sound. The speaker 151 announces the audible sound into the IC seat 111 of the infant carrier 101.

Each of the plurality of motors 123 is an electric motor. The plurality of motors 123 provides the motive forces necessary to rotate the infant carrier 101 to provide the infant with a rocking motion. The plurality of motors 123 provides the motive forces necessary to vibrate the infant carrier 101 to soothe the infant. The plurality of switching circuits 124 control the operation of each of the plurality of motors 123. The plurality of motors 123 further comprises a rotation motor 141 and a vibration motor 142.

The rotation motor 141 is an electric motor. The rotation motor 141 mounts within the IC shell 113 of the IC seat 111 such that the rotation of the rotation motor 141 rocks the small bed formed by the infant carrier 101. The rotation motor 141 generates the rocking motion of the invention 100. The rotation motor 141 further comprises a motor controller 143. The motor controller 143 is an electric circuit. The motor controller 143 electrically connects to the rotation motor 141. The motor controller 143 controls the speed of rotation of the rotation motor 141. The motor controller 143 further controls the direction of rotation of the rotation motor 141.

The vibration motor 142 is an electric motor. The vibration motor 142 is defined elsewhere in this disclosure. The vibration motor 142 mounts within the IC shell 113 of the IC seat 111 such that the rotation of the vibration motor 142 vibrates the small bed formed by the infant carrier 101. The vibration motor 142 generates the vibration of the invention 100.

Each of the plurality of switching circuits 124 is a maintained switch. The switch and the maintained switch are defined elsewhere in this disclosure. Each of the plurality of switching circuits 124 controls the flow of electric current through the control circuit 102. The plurality of switching circuits 124 comprises a master switch 171, a dual motor switch 172 circuit 162, a rotation motor 141 switch 173 circuit 163, a vibration motor 142 switch 174 circuit 164, and an audio device 121 switch 175 circuit 165.

The master switch 171 is a maintained switch. The master switch 171 controls the flow of electric energy from the power circuit 125 into each of the plurality of switching circuits 124.

The dual motor switch 172 circuit 162 is an electric circuit. The dual motor switch 172 circuit 162 controls the flow of electric energy from the power circuit 125 into the rotation motor 141 and the vibration motor 142. Specifically, the dual motor switch 172 circuit 162 allows electric energy to flow simultaneously through both the rotation motor 141 and the vibration motor 142 such that the rotation motor 141 and the vibration motor 142 will operate simultaneously. The dual motor switch 172 circuit 162 further comprises a dual motor switch 172 and a dual motor LED 182. The dual motor switch 172 and the dual motor LED 182 are electrically connected in a series circuit.

The dual motor switch 172 is a maintained switch. The dual motor switch 172 controls the flow of electric energy from the master switch 171 through the dual motor LED 182 into both the rotation motor 141 and the vibration motor 142. The dual motor LED 182 is an LED. The dual motor LED 182 electrically connects to the dual motor switch 172 such that the dual motor switch 172 illuminates when the dual motor switch 172 actuates to the closed position.

The rotation motor 141 switch 173 circuit 163 is an electric circuit. The rotation motor 141 switch 173 circuit 163 controls the flow of electric energy from the power circuit 125 into the rotation motor 141 such that the rotation motor 141 without requiring the operation of the vibration motor 142. The rotation motor 141 switch 173 circuit 163 further comprises a rotation motor 141 switch 173 and a rotation motor 141 LED 183. The rotation motor 141 switch 173 and the rotation motor 141 LED 183 are electrically connected in a series circuit.

The rotation motor 141 switch 173 is a maintained switch. The rotation motor 141 switch controls the flow of electric energy from the master switch 171 through the rotation motor 141 LED 183 into the rotation motor 141. The rotation motor 141 LED 183 is an LED. The rotation motor 141 LED 183 electrically connects to the rotation motor 141 switch 173 such that the rotation motor 141 switch 173 illuminates when the rotation motor 141 switch 173 actuates to the closed position.

The vibration motor 142 switch 174 circuit 164 is an electric circuit. The vibration motor switch 174 circuit 164 controls the flow of electric energy from the power circuit 125 into the vibration motor 142 such that the vibration motor 142 without requiring the operation of the rotation motor 141. The vibration motor 142 switch 174 circuit 164 further comprises a vibration motor 142 switch 174 and a vibration motor 142 LED 184. The vibration motor 142 switch 174 and the vibration motor 142 LED 184 are electrically connected in a series circuit.

The vibration motor 142 switch 174 is a maintained switch. The vibration motor 142 switch controls the flow of electric energy from the master switch 171 through the vibration motor 142 LED 184 into the vibration motor 142. The vibration motor 142 LED 184 is an LED. The vibration motor 142 LED 184 electrically connects to the vibration motor 142 switch 174 such that the vibration motor 142 switch 174 illuminates when the vibration motor 142 switch actuates to the closed position.

The audio device 121 switch 175 circuit 165 is an electric circuit. The audio device 121 switch 175 circuit 165 controls the flow of electric energy from the power circuit 125 into the audio device 121. The audio device 121 switch 175 circuit 165 further comprises an audio device 121 switch 175 and an audio device 121 LED 185. The audio device 121 switch 175 and the audio device 121 LED 185 are electrically connected in a series circuit.

The audio device 121 switch 175 is a maintained switch. The audio device 121 switch 175 controls the flow of electric energy from the master switch 171 through the audio device 121 LED 185 into the audio device 121. The audio device 121 LED 185 is an LED. The audio device 121 LED 185 electrically connects to the audio device 121 switch 175 such that the audio device 121 switch 175 illuminates when the audio device 121 switch 175 actuates to the closed position.

The power circuit 125 is an external power source. The power circuit 125 electrically connects to the balance of the control circuit 102. The power circuit 125 provides the electric energy required to operate the control circuit 102.

The following definitions were used in this disclosure:

Announce: As used in this disclosure, to announce means to generate audible sounds over a transducer.

Application or App: As used in this disclosure, an application or app is a self-contained piece of software that is especially designed or downloaded for use with a personal data device.

Audio: As used in this disclosure, audio refers to the reproduction of a sound that simulates the sound that was originally created.

Audio Device: As used in this disclosure, an audio device is a device that generates audible sound waves.

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted in to audible sounds by an audio device such as a speaker.

Battery: As used in this disclosure, a battery is a chemical device consisting of one or more cells, in which chemical energy is converted into electricity and used as a source of power. Batteries are commonly defined with a positive terminal and a negative terminal.

Bluetooth™: As used in this disclosure, Bluetooth™ is a standardized communication protocol that is used to wirelessly interconnect electronic devices.

Communication Link: As used in this disclosure, a communication link refers to the structured exchange of data between two objects.

Cushion: As used in this disclosure a cushion is a structure formed with a pad that is used to prevent injury or damage to a person or object.

Diode: As used in this disclosure, a diode is a two terminal semiconductor device that allows current flow in only one direction. The two terminals are called the anode and the cathode. Electric current is allowed to pass from the anode to the cathode.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Form Factor: As used in this disclosure, the term form factor refers to the size and shape of an object.

GPS: As used in this disclosure, and depending on the context, GPS refers to: 1) a system of navigational satellites that are used to determine the position, known as GPS coordinates, and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System. Methods to determine the distance and direction between any two sets of GPS coordinates are well-known and documented in the navigational arts.

Hand Carried: As used in this disclosure, when referring to an item or device, hand carried means that the item or device is small and light enough to allow a person to transport the item or device while holding the item or device in their hands.

Housing: As used in this disclosure, a housing is a rigid structure that encloses and protects one or more devices.

Infant: As used in this disclosure, an infant refers to a human child who: 1) is under 18 months old; and, 2) has not yet learned to walk.

Lock: As used in this disclosure, a lock is a releasable fastening device that secures a rotating mechanical device into a fixed position.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

PDD: As used in this disclosure, PDD is an acronym for personal data device.

Personal Data Device: As used in this disclosure, a personal data device is a handheld logical device that is used for managing personal information and communication. Examples of personal data device include, but are not limited to, cellular phones, tablets, and smartphones.

Recline: As used in this disclosure, recline refers to a person who lie backwards with the back supported. A person in such a position is said to be in a reclined position. Alternatively, recline may refer to a seat or chair wherein the back of the seat is in a sloped position such that a person sitting in the seat is in a reclined position. Such a seat or chair is often referred to as a reclining chair or a reclining seat.

Rotation: As used in this disclosure, rotation refers to the cyclic movement of an object around a fixed point or fixed axis. The verb of rotation is to rotate.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Vibration Motor: As used in this disclosure, a vibration motor is an electric motor that rotates an unbalanced weight in such a manner that the electric motor vibrates during operation. The vibration can be varied by varying the rotational speed of the vibration motor. The rotational speed is varied by varying the electric current flowing through the vibration motor.

WiFi™: As used in this disclosure, WiFi™ refers to the physical implementation of a collection of wireless electronic communication standards commonly referred to as IEEE 802.11x.

Wireless: As used in this disclosure, wireless is an adjective that is used to describe a communication link between two devices that does not require the use of physical cabling.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A baby carrier comprising an infant carrier, a control circuit, and a personal data device;

wherein the personal data device forms a communication link with the control circuit;

wherein the control circuit mounts in the infant carrier;

wherein the control circuit is an electric circuit;

wherein the control circuit forms a communication link with a personal data device;

wherein the control circuit receives one or more audio files from the personal data device over the communication link;

wherein the control circuit converts the one or more audio files into audible sounds;

wherein the control circuit announces the audible sounds into the infant carrier.

2. The baby carrier according to claim 1 wherein the baby carrier is a furniture item;

wherein the baby carrier is a hand carried item;

wherein the baby carrier is a reclined seat that forms a small bed.

3. The baby carrier according to claim 2 wherein the control circuit rocks the infant carrier;

wherein the control circuit vibrates the infant carrier.

4. The baby carrier according to claim 3 wherein the personal data device is a programmable electrical device;

wherein the personal data device further comprises an application and one or more audio files;

wherein the application of the personal data device forms an interface with the control circuit;

wherein the personal data device transmits the one or more audio files over a wireless communication link to the control circuit.

5. The baby carrier according to claim 4 wherein the infant carrier is the furniture item formed by the baby carrier;

wherein the infant carrier forms the small bed;

wherein the control circuit is contained within the infant carrier.

6. The baby carrier according to claim 5 wherein the infant carrier comprises an IC seat and an IC handle;

wherein the IC seat is the structure of the infant carrier that forms the small bed;

wherein the IC handle attaches to the IC seat such that the IC handle rotates relative to the IC seat;

wherein the IC handle further comprises an IC adjustable knob;

wherein the IC adjustable knob is a locking structure.

7. The baby carrier according to claim 6 wherein the control circuit comprises an audio device, a communication module, a plurality of motors, a plurality of switching circuits, and a power circuit;

wherein the audio device, the communication module, the plurality of motors, the plurality of switching circuits, and the power circuit are electrically interconnected;

wherein the plurality of switching circuits are accessible from the IC adjustable knob of the IC handle.

8. The baby carrier according to claim 7 wherein the IC seat further comprises an IC shell and an IC cushion;

wherein the IC shell is a mechanical structure;

wherein the IC shell is a rigid structure;

wherein the IC shell forms a supporting structure that forms the reclined seat formed by the IC seat;

wherein the IC shell further forms a housing that contains the control circuit.

9. The baby carrier according to claim 8 wherein the IC adjustable knob locks the IC handle into a fixed position relative to the IC seat;

wherein the IC adjustable knob releases the IC handle from its fixed position such that the IC handle will rotate relative to the IC seat;

wherein the IC adjustable knob then relocks the IC handle into its new fixed position relative to the IC seat;

wherein the IC adjustable knob further provides an interface to the control circuit.

10. The baby carrier according to claim 9 wherein the audio device is a programmable electronic device;

wherein the communication module is a wireless electronic communication device that allows the audio device to wirelessly communicate with the personal data device;

wherein specifically, the communication module establishes a wireless communication link between the control circuit and the personal data device;

wherein the audio device further comprises a speaker;

wherein the audio device receives one or more audio files from the personal data device over the communication link;

wherein the audio device converts the one or more audio files into audible sounds;

wherein the audio device announces the audible sounds into the infant carrier through the speaker.

11. The baby carrier according to claim 10 wherein each of the plurality of motors is an electric motor;

wherein the plurality of motors to rotate the infant carrier;

wherein the plurality of motors vibrate the infant carrier;

wherein the plurality of switching circuits control the operation of each of the plurality of motors.

12. The baby carrier according to claim 11 wherein the plurality of motors further comprises a rotation motor and a vibration motor;

wherein the rotation motor mounts within the IC shell of the IC seat such that the rotation of the rotation motor rocks the small bed formed by the infant carrier;

wherein the rotation motor generates the rocking motion of the baby carrier;

wherein the rotation motor further comprises a motor controller;

wherein the motor controller is an electric circuit;

wherein the motor controller electrically connects to the rotation motor;

wherein the motor controller controls the speed of rotation of the rotation motor;

wherein the motor controller further controls the direction of rotation of the rotation motor;

wherein the vibration motor mounts within the IC shell of the IC seat such that the rotation of the vibration motor vibrates the small bed formed by the infant carrier;

wherein the vibration motor generates the vibration of the baby carrier.

13. The baby carrier according to claim 12 wherein each of the plurality of switching circuits is a maintained switch;

wherein each of the plurality of switching circuits controls the flow of electric current through the control circuit.

* * * * *